United States Patent [19]

Knapp et al.

[11] 4,227,501

[45] Oct. 14, 1980

[54] FUEL INJECTION APPARATUS

[75] Inventors: Heinrich Knapp, Leonberg; Günther Jäggle, Stuttgart, both of Fed. Rep. of Germany

[73] Assignee: Robert Bosch GmbH, Stuttgart, Fed. Rep. of Germany

[21] Appl. No.: 961,808

[22] Filed: Nov. 17, 1978

[30] Foreign Application Priority Data

Jan. 7, 1978 [DE] Fed. Rep. of Germany ..... 2800614

[51] Int. Cl.[3] ..... F02M 39/00

[52] U.S. Cl. ..... 123/453; 123/455; 123/DIG. 2; 123/456

[58] Field of Search ..... 123/139 AV, 136, 139 AW, 123/139 ST, DIG. 2

[56] References Cited

U.S. PATENT DOCUMENTS

| | | | |
|---|---|---|---|
| 2,323,525 | 7/1943 | Ebel et al. | 123/139 AA |
| 3,974,809 | 8/1976 | Stumpp et al. | 123/139 AW |
| 4,079,717 | 3/1978 | Shirose | 123/140 MP |

FOREIGN PATENT DOCUMENTS

| | | | |
|---|---|---|---|
| 2547645 | 5/1977 | Fed. Rep. of Germany | 123/139 AW |
| 887934 | 11/1943 | France | 123/136 |

*Primary Examiner*—Ira S. Lazarus
*Assistant Examiner*—Magdalen Moy
*Attorney, Agent, or Firm*—Edwin E. Greigg

[57] ABSTRACT

A fuel injection apparatus is proposed for mixture-compressing, externally ignited internal combustion engines which provides continuous injection into the intake manifold. An air flow rate member and an arbitrarily actuatable throttle valve are disposed in sequence within the intake manifold, the air flow rate member being moved against a return force in accordance with the quantity of air flowing therethrough and thereby adjusts the movable member of a metering and distribution valve assembly disposed within the fuel supply line for the purpose of apportioning a quantity of fuel which is proportional to the air quantity. The control slide of the metering valve is actuated by means of a spring which moves in a direction to open the metering valve when the engine is being turned off. Branching off from each fuel injection line there is a scavenging line which is controllable by means of a filling valve provided with a movable valve member which opens a connection from the scavenging line to the fuel tank via a throttle point when the engine is turned off. When the engine is started, the movable valve member is displaced, with a delay, against a return force in the closing direction of the filling valve by means of the pressure of the fuel being supplied, so that the connection of the scavenging lines to the fuel tank is interrupted. Thus when the engine is started, all the fuel lines in the apparatus quickly fill with fuel, and smooth starting of the internal combustion engine takes place.

5 Claims, 2 Drawing Figures

FUEL INJECTION APPARATUS

BACKGROUND OF THE INVENTION

The invention relates to improvements in a continuous fuel injection system. A fuel injection system is already known which operates at a relatively high pressure in order to avoid difficulties in restarting the internal combustion engine which may arise because of fuel evaporation taking place after the engine is turned off. This high pressure system makes great demands on the electric fuel pump, particularly insofar as wear thereof is concerned as well as the electrical power required, and consequent need for security against points of leakage.

OBJECT AND SUMMARY OF THE INVENTION

The fuel injection system in accordance with the invention has the advantage over the prior art that the fuel injection system can operate with a lower system pressure yet simultaneously achieve secure starting of the internal combustion engine. Thus, an electric fuel pump with a smaller supply output may be employed.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
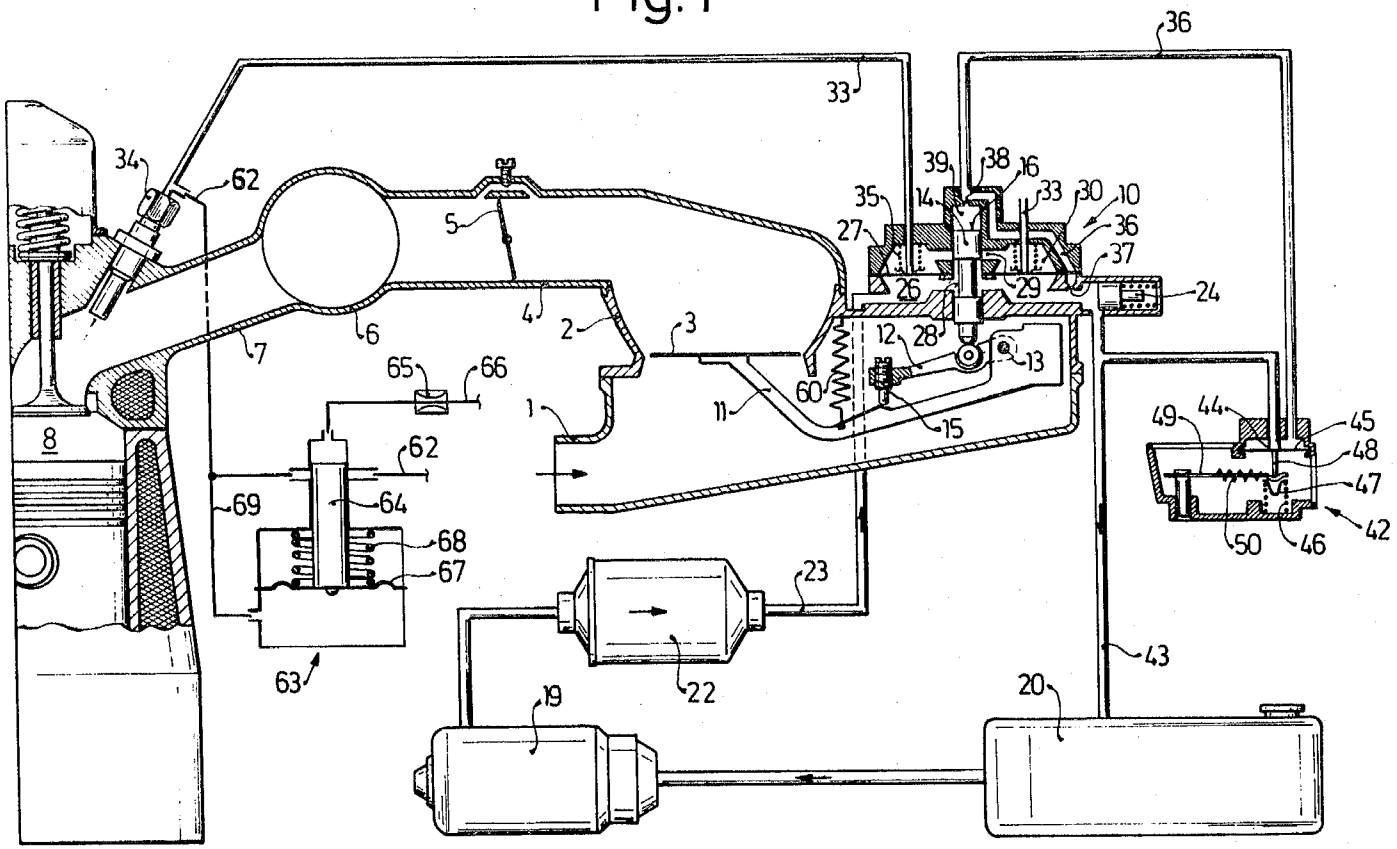
FIG. 1 shows a first exemplary embodiment of a fuel injection apparatus in simplified form.

Turning now to FIG. 1, there will be seen a fuel injection system including an intake manifold 1 having a conical section 2 which contains an air flow rate member 3 beyond which there is located an induction tube region 4 containing an arbitrarily settable throttle valve 5. Intake air flows through the induction tube in the direction of the arrow to a manifold 6 from which it is directed to individual induction tube regions 7 to one or more cylinders 8 of an internal combustion engine.

In the present case, the air flow rate member 3 is a baffle plate disposed transversely with respect to the direction of air flow and capable of displacement within the conical region 2 of the induction tube as an approximately linear function of the air flow rate through the tube. The air pressure between the air flow rate member 3 and the throttle valve 5 will be constant provided that the restoring force acting on the air flow rate member 3 is constant and that the air pressure ahead of the member 3 is also constant. The air flow rate member 3 controls the opening of a metering and distribution valve assembly 10. The air flow rate member 3 includes a main operating lever 11 and an auxiliary or correction lever 12. The motion of the air flow rate member 3 is transmitted by the operating lever 11 which is pivoted on the same shaft 13 as the correction lever 12 and which actuates the control slide 14 which is the movable member of the metering and distribution valve assembly 10. A mixture control screw 15 permits an adjustment of the desired fuel-air mixture. The end face 16 of the control slide 14 remote from the lever 11 experiences the pressure of a control fluid which is exerted onto the air flow rate member 3 and acts as a return force in opposition to the force of the flowing air.

Fuel is supplied by an electric fuel pump 19 which aspirates fuel from a fuel tank 20 and delivers it through a filter 22 and a fuel line 23 to the fuel metering and distribution assembly 10. A fuel system pressure controller 24 maintains the system pressure in the fuel injection system constant.

The fuel supply line 23 splits into several branches which lead to chambers 26 of the fuel valve assembly 10, whereby one side of a diaphragm 27 in each chamber is affected by fuel pressure. The chambers 26 also communicate with an annular groove 28 of the control slide 14. Depending on the axial position of the control slide 14, the annular groove overlaps control slits 29 to varying degrees permitting fuel to flow into chambers 30 which are divided from the chambers 26 by the diaphragm 27. From the chambers 30, fuel flows through fuel injection lines 33 to the individual injection valves 34 which are located in the vicinity of the engine cylinders 8 in the induction tube region 7. The diaphragm 27 is the movable valve member of a flat seat valve which is held open by a spring 35 when the fuel injection system is not operating. The diaphragm boxes defined, in each case, by a chamber 26 and a chamber 30, insure that the pressure drop at the metering valve 28, 29 is substantially constant independently of the relative overlap between the annular groove 28 and the control slits 29, i.e., independently of the fuel quantity flowing to the injection valves 34. This insures that the metered out fuel is exactly proportional to the control path of the slide 14.

During a pivoting displacement of the operating lever 11, the air flow rate member 3 is moved into the conical region 2 so that the varying annular cross section between the flow rate member and the conical wall remains proportional to the displacement of the air flow rate member 3. The force which generates the restoring force on the control slide 14 is a pressurized fluid, which, in this case, is fuel. To provide this fluid, a control pressure line 36 branches off from the main fuel supply line 23 via a decoupling throttle 37. The control pressure line 36 communicates via a damping throttle 38 with a pressure chamber 39 into which one end of the control slide 14 extends.

The control pressure line 36 contains a control pressure valve 42 which permits control fluid to return to the fuel tank 20 via a return line 43 without pressure. The control pressure valve 42 permits changing the pressure which produces the restoring force during the warm-up of the engine in dependence on time and temperature. The control pressure valve 42 is a flat seat valve having a fixed control valve seat 44 and a diaphragm 45 which is loaded in the closure direction by a spring 46. The spring 46 acts via a spring support 47 and a transmission pin 48 onto the diaphragm 45. When the engine temperature is below the normal operating temperature, a bimetallic spring 49 acts in opposition to the force of the spring 46. The bimetallic spring 49 carries an electric heater, the operation of which causes a diminution of the force of the bimetallic spring 49 on the spring 46, thereby increasing the control pressure in the control pressure line 36 and reducing the fuel enrichment of the mixture.

In known fuel injection apparatuses, problems arise in that after the hot engine is turned off there are difficulties when an attempt is made later to try to start it again, because of a subsequent higher heating of the engine which results from a lack of supplied cooling medium, i.e., cooling air or cooling water, the following takes place:

1. part of the fuel contained in the fuel injection apparatus evaporates and leads to a lack of fuel during starting because of volumetric reduction after cooling;
2. when the fuel cools, the pressure within the closed apparatus is reduced because of the volumetric reduction and devices which operate in accordance with pressure, such as the fuel metering valve, are adjusted into such a position that an overly rich fuel-air mixture is apportioned, so that the engine floods and thus stalls during starting;
3. a reduction in volume is brought about by leakages which are constantly present.

In order to obtain a system pressure which exceeds the vapor pressure of the fuel, the fuel supply pump must deliver a high supply pressure, which increases its cost and its power consumption and results in greater wear. Furthermore, there is the increased danger at higher pressures which can cause leakage and breaks in the lines with the result that the engine may catch fire. Therefore, in accordance with this invention it is provided that the fuel in the fuel injection apparatus can expand after the engine is turned off, and when the engine is again started, the lines and other parts of the fuel injection system first fill up to a pressure level which is below the opening pressure of the fuel injection valves 34. Only after this filling operation has taken place is there a further pressure build-up to the opening pressure level of the injection valves 34, through which the apportioned amount of fuel is then delivered continuously to the fuel injection apparatus. The system pressure thus is permitted to drop to approximately 3 bar. To this end, a tension spring 60 is positioned between the housing of the air flow rate member and the operating lever 11 in such a manner that after the engine is turned off, this tension spring 60 pulls the air flow rate member into an open position, by means of which the control slide 14 of the fuel metering valve 10 likewise opens the control slits 29. Furthermore, it will be noted that scavenging lines 62 branch off from the individual fuel injection lines 33 between the fuel metering valve 10 and the individual injection valves 34. These scavenging lines 62 lead to a filling valve 63. The points where the scavenging lines 62 branch off from the fuel injection lines 34 should be provided as close as feasible to the injection valves 34. The scavenging lines 62 are controlled by the movable valve member 64, which may be embodied as a piston, in such a manner that when the engine is turned off, the movable valve member 64 connects the scavenging lines 62 with the fuel tank 20 via a throttle point 65 which generates a counterpressure and via a return line 66, by which means the fuel enclosed in the apparatus can expand when the internal combustion engine is operational. The movable valve member 64 of the filling valve 63 can be connected with a diaphragm 67 which is urged on one side toward the opening direction of the filling valve 63 by a compression spring 68 and on the other side is subjected to the fuel pressure prevailing in the fuel injection lines 33 via a control line 69 which branches off from the scavenging line 62. Accordingly, when the engine is started, the fuel pump 19 first supplies fuel via the opened control slits 29 and the fuel injection line 33, by which means any bubbles which may form are carried back to the fuel tank via the opened scavenging lines 62. Only when the volume of air in the lines has been expelled does the filling valve 63 close the scavenging lines 62 toward the fuel tank, at a pressure which is preset by the compression spring 68 at approximately 1.7 bar. By this means, a further pressure build-up in the fuel injection apparatus can take place, and both a continuous injection through the fuel injection valves 34 at approximately 2.2 bar, and thus the secure starting of the engine, are assured.

Figure 2:
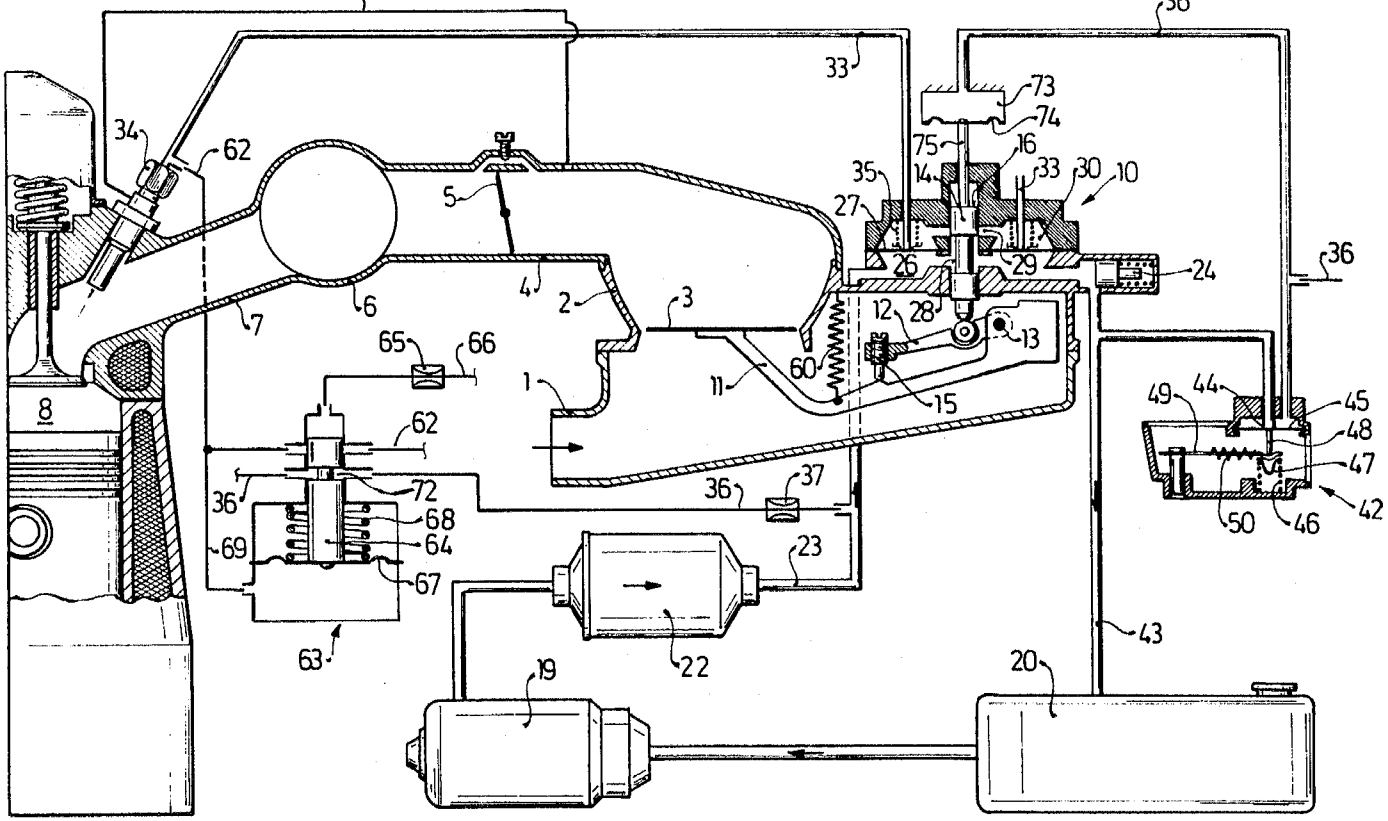
FIG. 2 shows a second exemplary embodiment of a fuel injection apparatus.

The function of the second exemplary embodiment according to FIG. 2 corresponds substantially to that of the fuel injection apparatus described in connection with FIG. 1, so that the same reference numerals indicate the parts which operate the same in both embodiments. A further lowering of the system pressure to approximately 2 bar may be accomplished through a better preparation of the fuel injected through the fuel injection valves 34 with air which is diverted from the induction tube region 4 via an air line 71 and which surrounds the injected stream of fuel in a known manner. In order to prevent the closing of the control slits 29 during the scavenging procedure when the engine is started, which would result from the pressure build-up in the control pressure line 36, the movable valve member 64 of the filling valve 63 is provided with an annular groove 72, which closes the control pressure line 36 when the filling valve 63 is opened and vice versa, so that the control pressure can only build up after the filling procedure is ended. The annular groove 72 of the filling valve 63 thereby controls the control pressure line upstream of the control pressure valve 42. Because of the low system pressure, a reinforcement of the effect of the pressure fluid in the control pressure line 36 is required. For this purpose, the control pressure line 36 communicates with a chamber 73 which has a reinforcement diaphragm 74 embodied as a movable wall which is in contact with a transmission member 75. The other end of the transmission member 75 is supported on the end face 16 of the control slide 14 and thus supplies the return force exerted on the air flow rate member 3.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. In a fuel injection system for mixture-compressing, externally ignited internal combustion engines having an air induction tube into which continuous injection is maintained, the system including: an air flow rate member and an arbitrarily actuatable throttle valve mounted in the air induction tube in series in the direction of air flow; a fuel metering and distributing valve assembly including a control slide serving as a movable member of the fuel metering and distributing valve assembly; a fuel tank, a fuel supply line connected to the fuel tank and the fuel metering and distributing valve assembly through which fuel is delivered from the fuel tank to the fuel metering and distributing valve assembly; at least one pressure control valve connected to the fuel metering and distributing valve assembly for controlling the fluid pressure exerted against the control slide; a plurality of fuel injection nozzles; and an equal plurality of fuel injection lines connected to the fuel metering and distributing valve assembly downstream of the control slide and to a respective one of the fuel injection nozzles, said control slide being displaceable against the fluid pressure controlled by said at least one pressure control valve by the air flow rate member in accordance with the quantity of air flowing in the air induction tube, the displacement of the control slide resulting in a quantity of fuel being apportioned to the fuel injection valves by the fuel metering and distributing valve assembly which is proportional to the air quantity flowing in the air induction tube, the improvement comprising:

a spring connected to the air flow rate member;

a filling valve connected to the fuel tank, said filling valve including a movable valve member and means providing a return force;

means defining a throttle point connected between the filling valve and the fuel tank; and a plurality of scavenging lines connected to a respective one of the fuel injection lines and to the filling valve, wherein:

(i) the control slide is actuated when the engine is turned off by said spring in the direction of opening of the fuel metering and distributing valve assembly;

(ii) the scavenging lines are controlled by the filling valve in such a manner that the movable valve member thereof opens each scavenging line toward the fuel tank via the throttle point when the engine is turned off; and (iii) the movable valve member of the filling valve is displaced, with a delay, against the return force in the closing direction of the filling valve by means of the pressure of the fuel being supplied when the engine is started, thereby interrupting the connection of the scavenging lines to the fuel tank.

2. The improved fuel injection system as defined in claim 1, wherein:

(iv) the scavenging lines are connected to the fuel injection lines adjacent to the fuel injection valves.

3. The improved fuel injection system as defined in claim 2, wherein:

(v) the filling valve further includes a diaphragm, subjected on one side to the return force and on the other side to the pressure of the fuel in the scavenging lines; and (vi) the movable valve member is actuated by means of said diaphragm.

4. The improved fuel injection system as defined in claim 1, the improvement further comprising:

a control pressure line connected to said at least one pressure control valve, to the fuel metering and distributing valve assembly and to the filling valve, the control pressure line carrying the pressure fluid which exerts pressure against the control slide, wherein:

(iv) the movable valve member controls the cross-sectional area of the control pressure line such that the control pressure line is closed when the filling valve is opened and opened when the filling valve is closed.

5. The improved fuel injection system as defined in claim 4, the improvement further comprising:

a reinforcement diaphragm;

means defining a chamber, said chamber being connected to the control pressure line and limited at one end by the reinforcement diaphragm; and a transmission member connected to the reinforcement diaphragm and the control slide, wherein:

(v) the chamber and reinforcement diaphragm being subjected to the pressure fluid carried by the control pressure line; and (vi) the transmission member serving to transmit a pressure force produced by the pressure fluid in said chamber to the control slide.

* * * * *